US005399381A

United States Patent [19]

Randall

[11] Patent Number: 5,399,381

[45] Date of Patent: Mar. 21, 1995

[54] PROTECTIVE FLOOR COVER FOR ELECTRIC BROOMS

[76] Inventor: Debbie Randall, Jones Rd., Cazenovia, N.Y. 13035

[21] Appl. No.: 192,554

[22] Filed: Feb. 7, 1994

[51] Int. Cl.[6] ..... A47L 7/00; A47L 9/00; B05D 1/28; B05D 3/00

[52] U.S. Cl. ..... 427/294; 15/246.3; 15/325; 15/393; 15/403; 118/50; 118/264; 427/429

[58] Field of Search ..... 15/393, 403, 325, 246.2, 15/246.3; 118/50, 264; 427/294, 429

[56] References Cited

U.S. PATENT DOCUMENTS

| | | | |
|---|---|---|---|
| 1,401,400 | 12/1921 | Green | 15/325 X |
| 1,657,111 | 1/1928 | Desnoyers | 15/393 |
| 1,920,002 | 7/1933 | Chason | 15/246.2 |
| 1,978,579 | 10/1934 | Hooks | 15/403 |
| 2,243,935 | 6/1941 | Williamson | 15/321 |
| 4,831,682 | 5/1989 | White | 15/325 X |
| 4,945,559 | 8/1990 | Flynn | 15/244.3 |
| 5,074,008 | 12/1991 | Palomino | 15/393 X |

FOREIGN PATENT DOCUMENTS

| | | | |
|---|---|---|---|
| 850321 | 9/1939 | France | 15/403 |
| 316307 | 12/1919 | Germany | 15/325 |
| 3403800 | 8/1985 | Germany | 15/325 |

*Primary Examiner*—Chris K. Moore
*Attorney, Agent, or Firm*—George R. McGuire

[57] ABSTRACT

A fabric covering adapted to be placed over the suction head of a conventional electric broom to prevent the scratching and/or marring of a non-carpeted floor surface. The fabric covering includes first and second opposed openings formed therethrough. The first opening includes an elastic band positioned in a peripheral hem to gather the covering about the suction head. The second opening is substantially, identically shaped as the suction opening formed in the bottom surface of the suction head. Therefore, once the covering is placed over the suction head, no portion of the suction head can contact either the floor surface or any inanimate objects which may be contacted when the electric broom is moved about the floor.

7 Claims, 2 Drawing Sheets

PROTECTIVE FLOOR COVER FOR ELECTRIC BROOMS

BACKGROUND OF THE INVENTION

FIELD OF INVENTION

The present invention relates to coverings placed over the head of a floor treating machine, and more particularly to coverings intended to prevent the bottom surface of a floor treating machine from contacting, and thus scratching, a non-carpeted floor surface.

INTRODUCTION

Cleaning hardwood, linoleum, or similar non-carpeted floor surfaces has long been a chore performed primarily by sweeping the dirt and dust into a pile with a broom and either using a pan to scoop up the debris or using a suction instrument to remove the debris. After sweeping the floor, it is a further practice to mop and/or wax the floor. This has always been done using a mop and a protective, coating substance such as oil. Performing these chores on a daily, or even weekly basis can become a burdensome, time consuming job. Thus, as time goes by it is performed less and less frequently, thereby causing floor surfaces to become dirtier and dirtier. Furthermore, satisfactory results are rarely achieved since sweeping the floor never entirely removes all the debris from the floor, thus not completely cleaning the floor.

Recently, suction machines intended to be used on non-carpeted floors, termed electric brooms, are often used in place of conventional brooms. These machines efficiently and effectively work at removing debris from the floor surface. Unfortunately the waxing of the floor still needs to be performed in a conventional manner. Furthermore, the hard plastic housing of the suction machine tends to scratch and mar floor surfaces as well as furniture, baseboards, and all other objects it may contact during use.

The prior art reveals several inventions directed towards coverings for suction machines to prevent the marring of furniture, baseboards and other objects which the suction machine may contact, but none directed towards use on any non-carpeted floor cleaning machine for the primary purpose of preventing scratching of the floor surface.

U.S. Pat. No. 4,831,682 to White discloses a guard to be placed about the top and lateral surfaces of a suction machine so as to prevent the marring of inanimate objects which may be contacted by the machine.

U.S. Pat. No. 1,920,002 to Chason discusses a mopping tool which may be attached to the bottom of a vacuum cleaner. When the tool is attached to the vacuum, the bottom surface of the cleaner is raised a predetermined distance above the floor thereby eliminating the effectiveness of the suction. Furthermore, the modification made to the vacuum to permit attachment of the tool requires a vacuum of predetermined configuration.

U.S. Pat. No. 4,945,599 discloses a fabric covering to be placed in complete covering relation over the head of a mop. Therefore, if this device were to be used on a vacuum cleaner, no suction would occur.

U.S. Pat. No. 2,243,935 to Williamson discloses an entire suction head to be remotely attached to a conventional vacuum cleaner. It includes a fabric covering placed over the suction head, but the covering is very specific, and complicated, to conform to the particular head configuration.

OBJECTS AND ADVANTAGES

It is a principal object of the present invention to provide a fabric covering to be placed over the head of a conventional electric broom to prevent the electric broom from scratching a non-carpeted floor surface.

It is a further object of the present invention to provide a vacuum head cover having a protective oil coating substance embedded therein.

It is yet another object of the present invention to provide a vacuum head cover which is removable, cleanable, and disposable.

It is still a further object of the present invention to provide a vacuum head cover which may be used on practically any shaped vacuum head.

Other objects will in part be obvious and in part appear hereinafter.

SUMMARY OF THE INVENTION

In accordance with the foregoing objects and advantages, the present invention provides a flexible fabric covering intended to be placed over the head of a conventional electric broom (an electric broom is a vacuum cleaner used on non-carpeted floor surfaces). The covering is preferably composed of a terrycloth type material and includes two opposed openings formed therethrough. The suction head of an electric broom is inserted through the first opening while the second opening is aligned with the suction opening formed through the floor contacting surface of the electric broom.

The first opening formed through the covering includes an elastic band positioned in a peripheral hem to gather the covering over the top surface of the suction head, thereby assuring a secure fit. To further retain the covering on a suction head, a pair of strings are positioned on opposite sides of the first opening. The strings may be tied around the handle portion of an electric broom, thereby providing further retainment means.

The second opening is defined by a rectangular, longitudinally elongated peripheral hem. Most electric broom's suction openings are rectangular and longitudinally elongated in shape, thus the covering's opening conforms to most electric broom heads. The covering and its openings permit an electric broom to be used in a conventional manner, but the terrycloth covering prevents the hard plastic suction head from scratching or marring the floor. The openings formed through the covering permit secure retainment of the covering on the suction head and do not diminish the suction occurring by the broom. In addition, since the peripheral walls of the suction head are covered by the terrycloth covering, any furniture or baseboards which may be contacted by the suction head will not be marred.

An additional feature of the present invention is that an oil or wax coating substance may be embedded in the floor contacting portion of the covering. Thus, when the electric broom is being used in a conventional manner, the floor is simultaneously being waxed or polished.

BRIEF DESCRIPTION OF THE DRAWINGS

The invention will be further described in connection with the accompanying drawings, in which.

DETAILED DESCRIPTION

Figure 1:
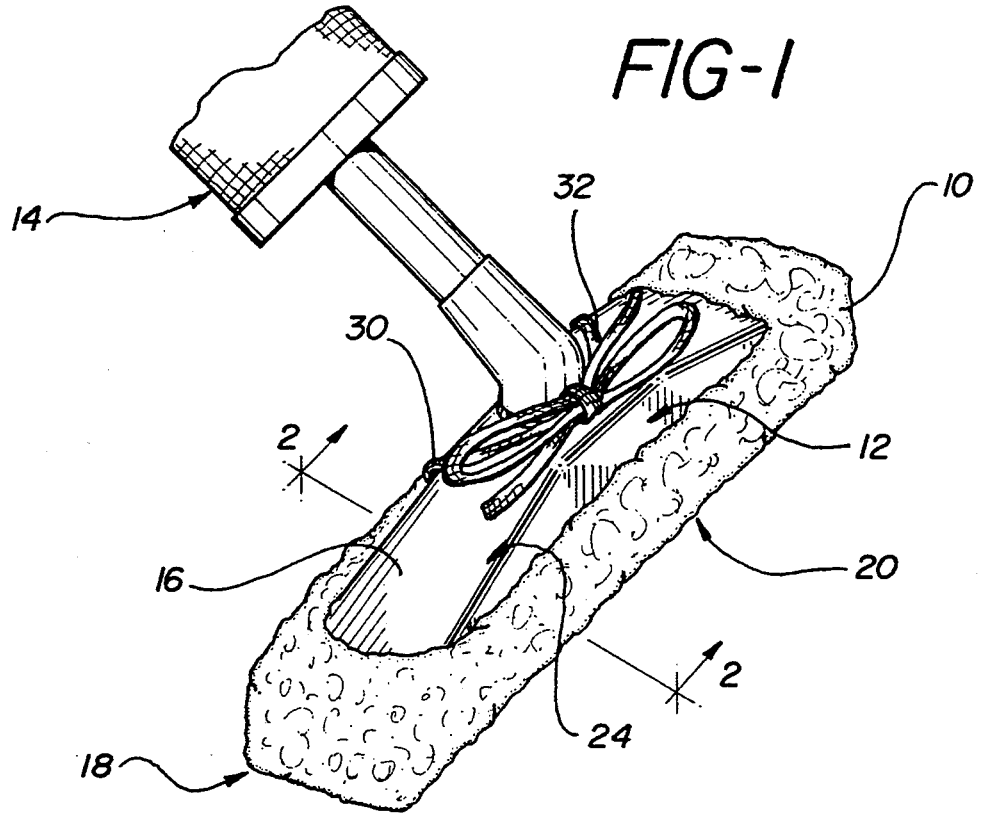
FIG. 1 is a perspective view showing the present invention in covering relation to a conventional electric broom head.
Figure 2:
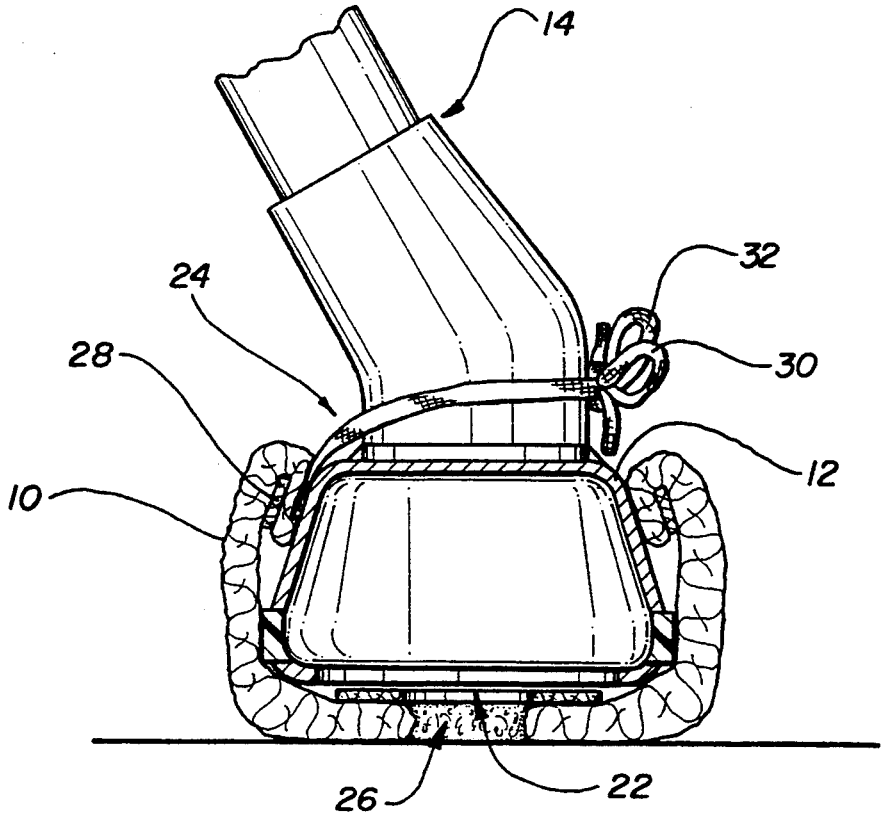
FIG. 2 is a cross-sectional view taken along line 2—2 of FIG. 1.
Figure 3:
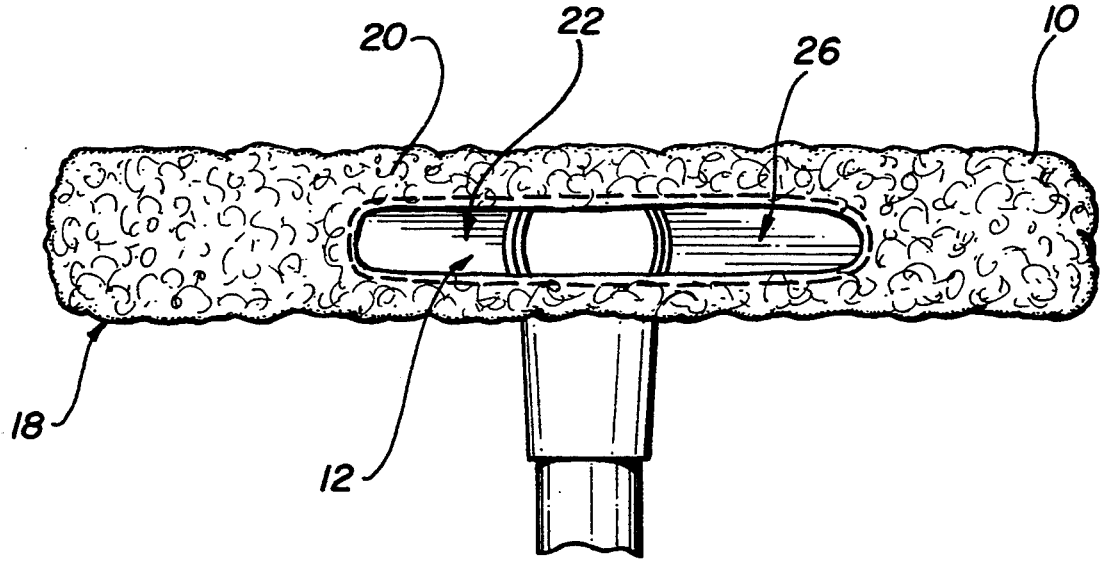
FIG. 3 is a bottom plan view of the present invention.

Referring now to the drawings wherein like reference numerals refer to like parts throughout, there is seen in FIG. 1 a fabric covering 10 securely positioned, in covering relation, over the suction head 12 of a conventional electric broom, the lower most portion of which is seen in FIG. 1, denoted generally by reference numeral 14. The employment of fabric covering 10 on electric broom 14 provides a practical solution for preventing non-carpeted floor surfaces from being scratched and marred as a result of being vacuumed.

Suction head 12 is shown in the figures as being substantially rectangular in shape and including a top surface 16, peripheral sidewalls 18, and a bottom surface 20 having a rectilinear opening 22 formed therethrough. Opening 22, of course, permits the flow of air to occur therethrough, and thus facilitate the suction of debris from a floor surface. The rectilinear shape of opening 22 is conventional, although opening 22 may be of any shape.

Fabric covering 10 includes first and second opposed openings 24, 26 formed therethrough. Opening 24 is defined by a peripheral hem in which a band of elastic 28 is enclosed. Elastic 28 gathers covering 10 about the top surface 16 of suction head 12. Opening 26 is positioned about suction head opening 22 such that bottom surface 20 is covered by covering 10 while opening 22 remains unimpeded. Covering 10 thus contacts a floor surface while suction head 12 is held in spaced relation thereto.

To place covering 10 on electric broom 14, suction head 12 is inserted through opening 24 and covering 10 is adjusted until opening 26 is accurately positioned about opening 22. To further secure covering 10 on suction head 12 a pair of strings 30, 32 are attached to covering 10 adjacent opening 24 on opposite sides of electric broom 14. Hence, strings 30, 32 may be tied around broom 14 to further secure covering 10 on suction head 12. Once covering 10 is securely placed over suction head 12, electric broom 14 may be moved about a floor surface in a conventional manner.

An oil or wax, such as lanolin, may be embedded into covering 10. Therefore, as broom 14 is moved about a floor surface the oil is coated onto the floors thereby protecting the floor.

What is claimed is:

1. A protective cover for use with a floor treating machine having a suction head which includes a floor engaging surface with an opening of predetermined configuration formed therethrough to permit passage of particles therethrough, said head further having peripheral side walls and a top surface having a handle extending upwardly therefrom, said protective cover comprising:

a) a flexible fabric covering having first and second opposed openings, said first opening having an elastic gathering positioned thereabout, said second opening substantially correspondingly shaped in said predetermined configuration of said suction head opening, wherein said first opening is positioned about said handle, said second opening is positioned about said suction head opening, and said flexible fabric extending in covering relation to said peripheral walls, a portion of said top portion, and a portion of said floor engaging surface, whereby said covering prevents said floor engaging surface from contacting a floor.

2. The invention according to claim 1 wherein said covering further includes a pair of independent strings positioned on opposite sides of said first opening, said strings adapted to be tied about said handle, thereby securely attaching said covering to said suction head.

3. The invention according to claim 1 wherein said covering includes means for coating said floor with a predetermined substance.

4. The invention according to claim 3 wherein said coating means includes said predetermined substance being embedded into said fabric covering, whereby said predetermined substance is applied to said floor upon movement of said suction head over said floor.

5. The invention according to claim 4 wherein said predetermined substance is lanolin.

6. The invention according to claim 1 wherein said fabric covering is composed of terrycloth.

7. A method for cleaning and protecting a non-carpeted floor surface using a vacuum cleaner having a suction head with a suction opening and a fabric, suction head covering having first and second opposed openings comprising the steps of:

a) embedding a predetermined, protective coating substance into said fabric covering;

b) inserting said suction head through said first opening of said fabric covering, wherein said fabric covering is positioned in covering relation about said suction head;

c) aligning said second opening of said fabric covering with said suction opening; and d) moving said vacuum cleaner over said floor in a conventional manner, whereby said floor is cleaned by having foreign particles removed from said floor by being sucked through said suction opening into said vacuum cleaner, and said floor is protected by being coated with said predetermined substance.

* * * * *